US006783901B1

(12) United States Patent
Hawkins et al.

(10) Patent No.: US 6,783,901 B1
(45) Date of Patent: Aug. 31, 2004

(54) PHOTOSENSITIVE PLASTICS FILMS AND INFORMATION STORAGE DEVICES

(75) Inventors: Michael Hawkins, Frodsham (GB); David Michael Newbitt, Southampton (GB)

(73) Assignee: CPFilms, Inc., Martinsville, VA (US)

( * ) Notice: Subject to any disclaimer, the term of this patent is extended or adjusted under 35 U.S.C. 154(b) by 0 days.

(21) Appl. No.: 09/787,344

(22) PCT Filed: Sep. 17, 1999

(86) PCT No.: PCT/GB99/03097

§ 371 (c)(1),
(2), (4) Date: Mar. 16, 2001

(87) PCT Pub. No.: WO00/17709

PCT Pub. Date: Mar. 30, 2000

(30) Foreign Application Priority Data

Sep. 18, 1998 (GB) ..... 9820317

(51) Int. Cl.[7] ..... G03C 1/73; H04H 9/00

(52) U.S. Cl. ..... 430/20; 430/945; 430/270.5; 250/474.1; 250/372; 348/2

(58) Field of Search ..... 430/945, 20, 270.5; 250/474.1, 372; 348/2

(56) References Cited

U.S. PATENT DOCUMENTS

| | | | | | |
|---|---|---|---|---|---|
| 3,656,247 | A | * | 4/1972 | Bushnell et al. | 40/21 |
| 4,845,240 | A | | 7/1989 | Hibino | 430/445 |
| 4,954,380 | A | * | 9/1990 | Kanome et al. | 430/945 |
| 5,208,132 | A | * | 5/1993 | Kamada et al. | 430/138 |
| 5,248,584 | A | * | 9/1993 | Miura et al. | 430/945 |
| 5,432,048 | A | | 7/1995 | Taniguchi | 430/338 |
| 5,581,090 | A | * | 12/1996 | Goudjil | 250/474.1 |
| 5,681,420 | A | * | 10/1997 | Yamane | 156/387 |
| 5,790,169 | A | | 8/1998 | Hohenacker | 348/2 |
| 5,801,748 | A | | 9/1998 | Hohenacker | 348/2 |
| 5,914,197 | A | * | 6/1999 | Goudjil | 428/537.5 |
| 6,001,463 | A | * | 12/1999 | Shibahara et al. | 428/216 |
| 6,154,432 | A | * | 11/2000 | Faruqi et al. | 369/103 |

FOREIGN PATENT DOCUMENTS

| | | | |
|---|---|---|---|
| EP | 354070 A2 | | 2/1990 |
| EP | 426437 A2 | | 5/1991 |
| EP | 488153 A1 | | 6/1992 |
| EP | 711046 A1 | | 5/1996 |
| GB | 600999 | | 4/1948 |
| JP | 62-070850 | * | 4/1987 |
| JP | 211779 | * | 8/1997 |
| WO | WO91/12139 A1 | | 8/1991 |
| WO | WO94/12352 A1 | | 6/1994 |

OTHER PUBLICATIONS

The Merck Index, 10th Ed. (1983) pp. 8676.*

* cited by examiner

*Primary Examiner*—Martin Angebranndt
(74) *Attorney, Agent, or Firm*—Howson and Howson

(57) ABSTRACT

A plastics film is provided which is filled with a filler, has diffuse reflective properties and is coated with a coating containing a photosensitive organic compound. The film is useful in the production of information storage devices by combining it with a perforated mask disposed on the side of the film which bears the coating.

6 Claims, No Drawings

PHOTOSENSITIVE PLASTICS FILMS AND INFORMATION STORAGE DEVICES

FIELD OF THE INVENTION

This invention relates to polymeric films comprising photosensitive, particularly photochromic, organic compounds, which films exhibit a high response to exposure to electromagnetic radiation, particularly visible light, and to information storage devices incorporating such films.

As used herein, the unqualified expression "light" refers generally to electromagnetic radiation in the UV-visible region, and "colour" refers generally to the spectral properties within the UV-visible region of light or of an article.

BACKGROUND ART

WO-A-94/24785 discloses an information storage device comprising a photosensitive film for application to a small region of a monitor such as a television screen. The photosensitive material in the film may be photochromic. The photosensitive film may be metallised with gold or silver on its reverse side, both to guard the photosensitive material from light falling on the reverse side of the film, and to reflect light falling on the obverse side of the film but passing through the film without interacting with the photosensitive material back towards the photosensitive material. The film may be provided on its obverse side with a lens to focus light falling on the film and thus to yield a sharp image.

In some information-collecting applications, an image consisting of discrete spots (as opposed to a continuous image) may be found suitable. In such a case the obverse side of the film may advantageously be provided with a perforated mask, for example of cardboard, as focusing device instead of a plastics lens. The mask may be markedly thicker than the film, so that the photosensitive material is activated only by light falling on the storage device at a near-perpendicular angle to the film. The desirability of employing a photosensitive material of high sensitivity will be appreciated, namely in order that a large colour difference between exposed and unexposed areas can be obtained in a short exposure time. However, there may be problems in reading the information which has been collected in a storage device of such construction. The reading step involves illumination with light of wavelength characteristic of the photosensitive material (unexposed or exposed) and analysis of the reflected light. If the photosensitive film is unreflective (either because the film has no backing or because the film has light-absorbent properties), the amount of reflected light is low. If the film is highly reflective, for example if it is metallised on its reverse side, the amount of reflected light is so great that it is difficult to distinguish between exposed and unexposed areas. The present invention addresses such problems.

DISCLOSURE OF THE INVENTION

According to the invention, there is provided a plastics film filled with a filler and having diffuse reflective properties, the film bearing a coating which contains a photosensitive organic compound.

The plastics film may be of conventional polymeric material such as regenerated cellulose, cellulose acetate or polyamide, although a polyester such as poly(ethylene terephthalate) may be preferred. The polymer desirably exhibits high transparency at relevant wavelengths.

The filler is preferably a pigment, more preferably a white pigment. Titanium dioxide (titania) is a particularly preferred white pigment for use when the photosensitive compound is chosen to react on exposure to visible light, because of its good diffuse reflective properties to visible light. Other common white pigments such as barium sulphate tend to confer a relatively high degree of specular reflection to visible light on a filled film, and they are accordingly less preferred. On the other hand, if the compound is chosen to react on exposure to UV light, barium sulphate may be preferred to titania, because barium sulphate exhibits better diffuse reflectivity than titania to UV light. Other kinds of filler, for example polymer beads, may be employed. If an aerated or microvoided polymeric film is employed, the filler is generally a gas such as air. A decisive factor is that the refractive index of the filler particles (or voids) should differ from that of the polymer of the film so as to confer diffuse reflective properties on the film. The size and shape of the particles (or voids) may also be influential. The nature of the filler and filled film are not thought to affect the photochemistry of the photosensitive compound and accordingly are not thought to modify the nature of the information collecting step.

The diffuse and specular reflective properties of a film may be measured by conventional techniques, for example using a UV-visible spectrometer equipped with an integrating sphere for reflectance measurement and an optional light trap for removal of the specularly-reflected component. At relevant wavelengths, the plastics film preferably exhibits a diffuse reflectivity of at least 80%, more preferably at least 85%, and a specular reflectivity of no more than 5%, preferably of no more than 3% (all percentages being based on the reflectivity of a standard barium sulphate plate).

The coating may comprise more than one photosensitive organic compound. The photosensitive compound is preferably a photochromic compound. Photochromic organic compounds are known and include the photochromic fulgides and diarylethenes. Such compounds change colour when exposed to light whose wavelength corresponds to a spectral absorption peak of the compound. This colour change is the result of isomerisation, and it is reversed if the isomerised compound is exposed to light whose wavelength corresponds to a spectral absorption peak of the isomerised compound. The efficiency of the isomerisation reaction differs for different compounds, depending on the efficiency with which the molecule absorbs photons and on the efficiency with which the molecule isomerises after absorption of a photon. The invention preferably employs a photochromic compound which reacts with a high degree of efficiency, most preferably in both the forward direction and the reverse direction. The photochromic compound preferably has a low tendency to thermochromism (colour change resulting from heat-induced isomerisation). The photochromic compound preferably strongly absorbs light from one or more of the RGB guns in a conventional television. A preferred compound is the fulgide Aberchrome 670 (Trade Mark of Aberchromics Ltd.) (CAS Registry No. 94856-25-4), which exhibits a rapid colour change (is rapidly bleached) by exposure to light of wavelength around 530 nm (corresponding to the green gun).

The coating preferably comprises a polymer in which the photosensitive compound is dispersed at molecular level. In general, any polymer compatible with the compound may be used. It will be appreciated that polymers which absorb light at relevant wavelengths, or which may react with the compound, or in which the compound may crystallise, will in general be unsuitable. An olefinic polymer such as polystyrene may generally be found suitable. The polymer of the coating desirably exhibits high transparency at relevant wavelengths. Coating compositions may be made for example by dissolving the polymer and compound in a solvent, and such compositions may be applied to the film by conventional techniques such as gravure printing or other printing methods.

The film is preferably metallised on its reverse side. Metallisation serves primarily to guard the photosensitive compound from light falling on the reverse side of the film and secondarily to provide a reflective surface from which light passing through the film can be reflected back towards the photosensitive compound through the diffuse reflective film in the information collecting step. The efficiency of light collection may in consequence be increased by some 10 or 20 percent.

The invention further provides an information storage device which comprises in combination the film described hereinabove and a perforated mask disposed on the coating-bearing side of the film. The mask may for example be perforated with holes of from 1 to 5 mm diameter. The thickness of the mask may for example be from 0.5 times to 2.5 times the diameter of the holes.

An information storage device according to the invention has the advantage that instrumental measurement or the colour of the film is markedly easier than in a device which incorporates a film which exhibits highly specular reflective properties or which exhibits little or no reflective properties. Measurement involves the analysis of light reflected from the film, and if the film exhibits excessive specular reflection the instrument may be swamped with reflected light owing to the fact that both the incident and the reflected light travel at near-perpendicular angle to the film.

Photosensitive compounds such as photochromic compounds are expensive materials. It is both economic and technically efficient to confine application or the photosensitive compound by applying the coating containing the photosensitive compound in the form of spots corresponding to the holes in the mask. The diameter of the spots is preferably larger than the diameter of the holes for maximum efficiency of light capture and to allow some latitude in registration.

The coating may comprise a small amount, for example 0.5 to 2% by weight, of a non-photosensitive light-absorbing compound. This has the advantage that the spots can be recognised instrumentally by spectral measurement at a fixed wavelength corresponding to an absorption peak of the non-photosensitive compound, irrespective of the current colour of the photosensitive compound. If this compound absorbs visible light, the spots can be visually recognised even when the photosensitive compound is in visually colourless form. The non-photosensitive compound should be of low absorbance at wavelengths at which the photosensitive compound is of high absorbance in either isomeric state.

The invention is illustrated by the following Example, in which parts and proportions are by weight except where otherwise specified:

EXAMPLE

A coating composition was prepared by dissolving 17.98 g Aberchrome 670 (Trade Mark of Aberchromics Limited), 1.19 g Waxoline Yellow GFW (Trade Mark of BASF AG) and 53.94 g polystyrene (Lacqrene 1810, Trade Mark of Elf Atochem) in 327.64 g 70:30 toluene/methylethylketone. The composition was applied by gravure printing to a titania-filled polyethylene terephthalate film (Melinex 365, Trade Mark of Du Pont), which had been metallised on the heatseal side. (Melinex 365 comprises a filled poly(ethylene terephthalate) film 23 micron thick coated on one side with amorphous unfilled poly(ethylene isophthalate)/poly (ethylene terephthalate) 3 micron thick as heatseal layer. The heatseal layer is not thought to be of any relevance in the present invention.) The composition was applied in the form of circular spots of about 7 mm diameter. The spots were disposed in groups of 16, comprising concentric circles of 6 spots in an inner circle and 10 spots in an outer circle, the diameter of the outer circle being about 4 cm. The groups were disposed in regular square array at a density of about 310 groups per square metre. The total coating weight in the coated areas was 1.417 g/sq.m, of which 0.354 g/sq.m was Aberchrome 670. The film was also marked with registration marks to aid in subsequent laminating, stamping and slitting processes. On exposure to UV light (UV-A from 5×8W Philips Blacklight tubes), the Spots turned from yellow to deep brown (colouration mode). The colour change was reversed (bleaching mode) by exposure to ambient room lighting in a short time of about 10 min.

An information storage device was made by joining together in the following order:

(1) a paper backing layer;
(2) the film described above, with its metallised surface towards the paper layer; and
(3) two layers of cardboard each 2 mm thick, perforated with 2.8 mm diameter holes corresponding to the spots on the film, all being 40 mm diameter discs.

A similar film and device were prepared using a barium sulphate-filled poly(ethylene terephthalate) film (Melinex 329, Trade Mark of Du Pont). The instrumentally-measured difference between this device before and after exposure to a given amount of visible light was less than it was for the device containing the titania-filled film.

In a comparative experiment was tested an acetate film containing Aberchrome 670 in solid solution. The bleaching rate was slow in comparison with either of the filled films. It is thought that this was because the absence of a reflective backing resulted in less efficient photon capture.

The specular and diffuse reflective properties of poly (ethylene terephthalate) films filled with titania and with barium sulphate were measured using a Perkin-Elmer Lambda 9 (Trade Mark) UV-visible-NIR spectrophotometer equipped with an integrating sphere for reflectance measurement and an optional light trap for removal of the specularly-reflected component. The results were expressed as percentages of the reflectivity of a standard barium sulphate plate supplied by Perkin-Elmer. The relative amounts of specular and diffuse reflection were similar over the range from about 420 to 700 nm, although the total amount of reflection declined steadily with increasing wavelength. The following results were obtained at 560 nm:

| Filler | Diffuse reflection % | Specular reflection % |
|---|---|---|
| Titania | 85 | 2.5 |
| Barium sulphate | 83.5 | 5 |

What is claimed is:

1. A light-sensitive film composite sensitive at room temperature to light emissions from screens of monitors and televisions, comprising a plastics film formed from a first polymeric compound containing a white particulate filler and having reflection properties of less than 5% specular reflection and greater than 80% diffuse reflection, said plastics film bearing on one side a coating comprising a transparent second polymeric material and a photochromic fulgide having low tendency to thermochromism and which is sensitive to green light emitted by said screens, said plastics film on its other side being metallized, the filler in said plastics film conferring diffuse reflective properties on said plastics film at a wavelength characteristic of the photochromic fulgide.

2. A light-sensitive film composite according to claim 1, wherein the second polymeric material is polystyrene.

3. A light-sensitive film composite according to claim 2, wherein said plastics film contains titanium dioxide and has a diffuse reflectivity of at least 85% and a specular reflectivity of no more than 3%, based on a standard barium sulphate plate.

4. A light-sensitive film composite according to claim 1, wherein said particulate filler of said plastics film is titanium dioxide, and said plastics film has a specular reflectivity of no more than 3% and a diffuse reflectivity of at least 85%, based on standard barium sulphate.

5. A light-sensitive film composite according to claim 1, wherein said second polymeric material is compatible with the photochromic fulgide and does not react with the fulgide, does not cause the fulgide to crystallize, and does not substantially absorb light of wavelengths to which the fulgide is sensitive.

6. An information storage device for use with screens of monitors and televisions, comprising a light-sensitive film composite sensitive at room temperature to light emissions from the screens, said light sensitive film composite comprising a plastics film formed from a first polymeric compound containing a white particulate filler and having reflection properties of less than 5% specular reflection and at least 80% diffuse reflection, said plastics film bearing on one side a coating comprising a transparent second polymeric material and a photochromic fulgide sensitive to green light emitted by the screens and having low tendency to thermochromism, the coating being applied in discrete spots with its other side being metallized, the filler in said plastics film having a refractive index differing from a refractive index of the first polymeric material and conferring diffuse reflective properties on said plastics film at a wavelength characteristic of the photochromic fulgide, and a perforated mask disposed on said one side of said plastics film over said coating with the perforations corresponding with the spots on said one side of said plastics film.

* * * * *